US005318190A

United States Patent [19]

Mason

[11] Patent Number: 5,318,190

[45] Date of Patent: Jun. 7, 1994

[54] ADJUSTABLE DISPLAY TRAY

[75] Inventor: Timothy L. Mason, Melville, N.Y.

[73] Assignee: New Dimensions Research Corporation, Melville, N.Y.

[21] Appl. No.: 950,311

[22] Filed: Sep. 24, 1992

[51] Int. Cl.[5] ..... A47F 7/00

[52] U.S. Cl. ..... 211/41; 211/175; 211/72; D32/56

[58] Field of Search ..... 211/41, 175, 72, 73, 211/181, 132, 195; D32/55, 56

[56] References Cited

U.S. PATENT DOCUMENTS

| | | | |
|---|---|---|---|
| 1,971,523 | 8/1934 | Feingold | 211/41 |
| 2,443,404 | 6/1948 | Tallarico | 211/41 |
| 2,513,177 | 6/1950 | Irwin | 211/175 X |
| 2,520,389 | 8/1950 | Ferris | 211/195 X |
| 2,989,189 | 6/1961 | Leone | 211/41 |
| 3,486,631 | 12/1969 | Rodman | 211/41 |
| 3,889,815 | 6/1975 | Merle | 211/41 |
| 4,191,295 | 3/1980 | Tams | 211/41 |
| 4,969,560 | 11/1990 | Stanfield | 211/175 X |

*Primary Examiner*—Robert W. Gibson, Jr.

*Attorney, Agent, or Firm*—Salter, Michaelson & Benson

[57] ABSTRACT

A display tray is adjustable for receiving and displaying differently sized plates and bowls. The tray includes a bottom wall, a pair of side walls connected thereto by living hinges such that the side walls can be moved to different angular positions, and a front wall. The bottom wall and side walls are further provided with rib elements which engage the plates and act as frictional treads to prevent the plates and bowls from tipping over. In order to maintain the side walls in the desired angular position a comb-like partition having a plurality of teeth is provided. The partition extends through slots in the side walls so that the side walls can be snapped in between any two adjacent teeth. To further maintain the side walls in the desired angular position wire rods are provided having front bent ends which are adapted to be inserted into receptacles which are provided on the inner surface of the front wall.

13 Claims, 3 Drawing Sheets

ADJUSTABLE DISPLAY TRAY

BACKGROUND OF THE INVENTION

The instant invention relates to merchandise displays and more particularly relates to an adjustable display tray for packages of plates, bowls, circular food packages, and the like.

Heretofore, merchandise displays have been well known in the art. In this regard, the U.S. patent to Wilson U.S. Pat. No. 1,702,987 discloses a display tray whereby merchandise, such as tea or tobacco, may be easily stocked and dressed on store shelves. One problem which is commonly associated with many of the available merchandise displays is a lack of means for adjusting the dimensions and angular alignments of the display for articles of differing shape, size and configuration. This problem is of particular importance in the display of plates, bowls, and circular food packages, including packaged paper or plastic plates and bowls. It is well known that packaged paper plates and bowls are available in a variety of differing sizes and shapes. To accommodate for the variety of individual sizes and shapes, it has been common practice in the prior art to provide a plurality of different size displays that have no adjustability capacity. It can readily be appreciated that providing different size displays for each type or size of plate or bowl is extremely cost ineffective, and accordingly it has been determined that there is a need for a display tray which is adjustable for receiving and displaying a plurality of different sizes and shapes of plates and bowls.

SUMMARY OF THE INVENTION

The instant invention provides an adjustable folding display tray which receives and displays plates and bowls of different sizes. Briefly, the display tray comprises a bottom wall, and a pair of side walls hingedly connected thereto, as by living hinges, such that the side walls can be moved to a plurality of different angular positions to receive differently sized plates. The tray further comprises a front wall, and a plurality of rib elements which extend along the top inside edges of the side walls and along the center of the bottom wall. The rib elements engage the edges of the plates and act as frictional treads to prevent the plates from tipping over or sliding lengthwise of the tray. In order to maintain the side walls in a desired angular position, a comb-like partition having a plurality of teeth is provided. The partition extends through slots in the side walls such that the side walls can be snapped between any two adjacent teeth and fixed in a desired position. To further maintain the side walls in the desired angular position, wire rods are provided which extend along the outside surface of the side walls. The wire rods include bent front ends which are adapted to be inserted into receptacles provided on the inner surface of the front wall. The dimensions of the tray are also adjustable. For shortening the length of the tray, the bottom and side walls are provided with break-away sections at the rear portions thereof, and for reducing the width of the tray, the front wall is provided with break-away sections at the outer side portions thereof. In addition, the tray is provided with slots in the bottom wall for attaching the tray to a table with fastener elements, and a joiner clip for connecting a plurality of trays in side-by-side arrangement.

Accordingly, it is an object of the instant invention to provide an adjustable display tray which is capable of receiving and displaying plates, bowls, and even packaged food items of different sizes.

It is another object to provide a display tray which has hinged side walls which can be moved to a plurality of different angular positions.

It is yet another object of the instant invention to provide a display tray having break-away sections for adjusting the length and width of the tray.

It is still another object to provide a display tray having rib elements for engaging the plates and bowls and maintaining them in an upright position.

A further object is to provide a display tray of the character described wherein the tray can be shipped in knocked-down disassembled condition to minimize shipping costs, and can then be easily assembled at point of use with the desired size adjustments easily made.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
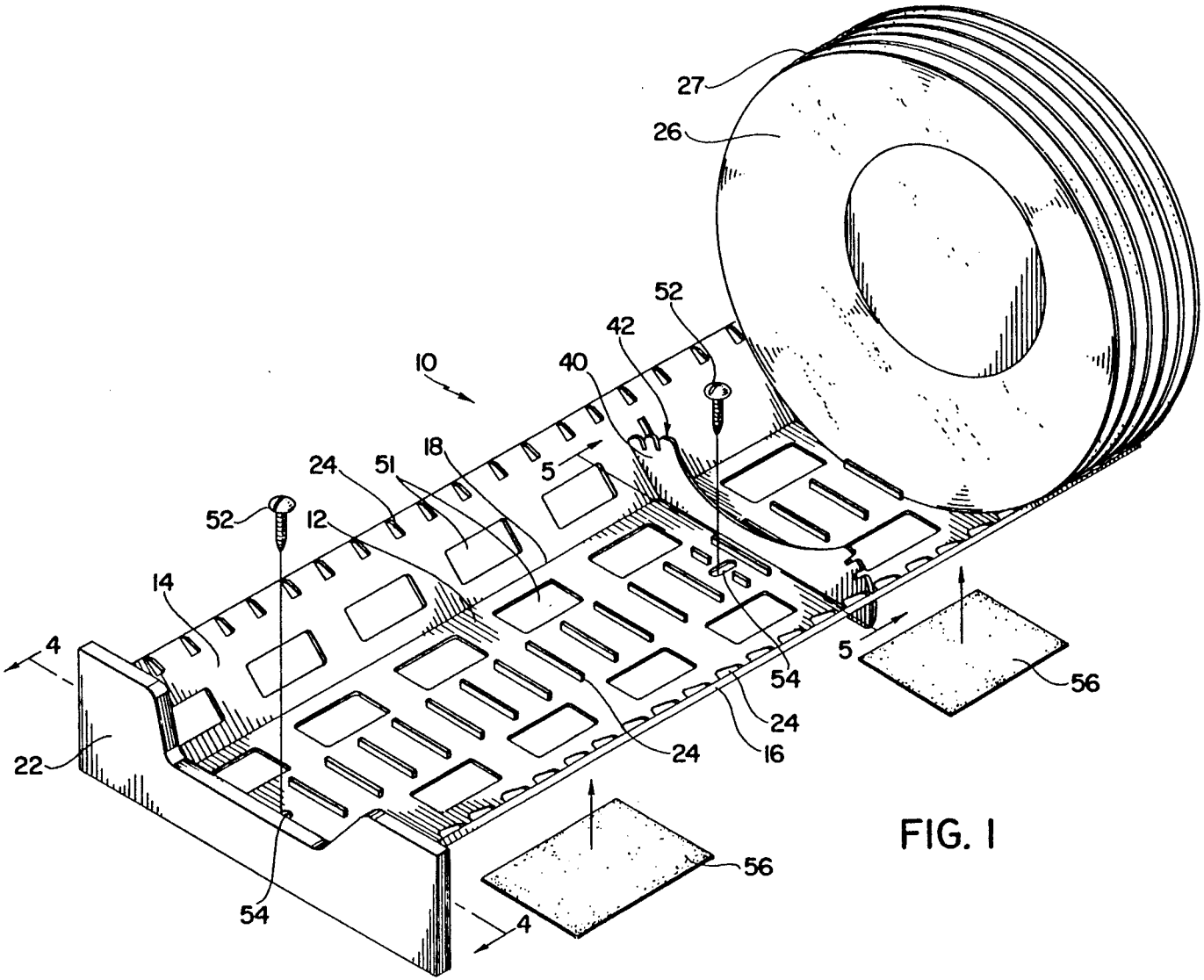
FIG. 1 is a perspective view of the adjustable display tray of the instant invention with a package of plates mounted therein.
Figure 2:
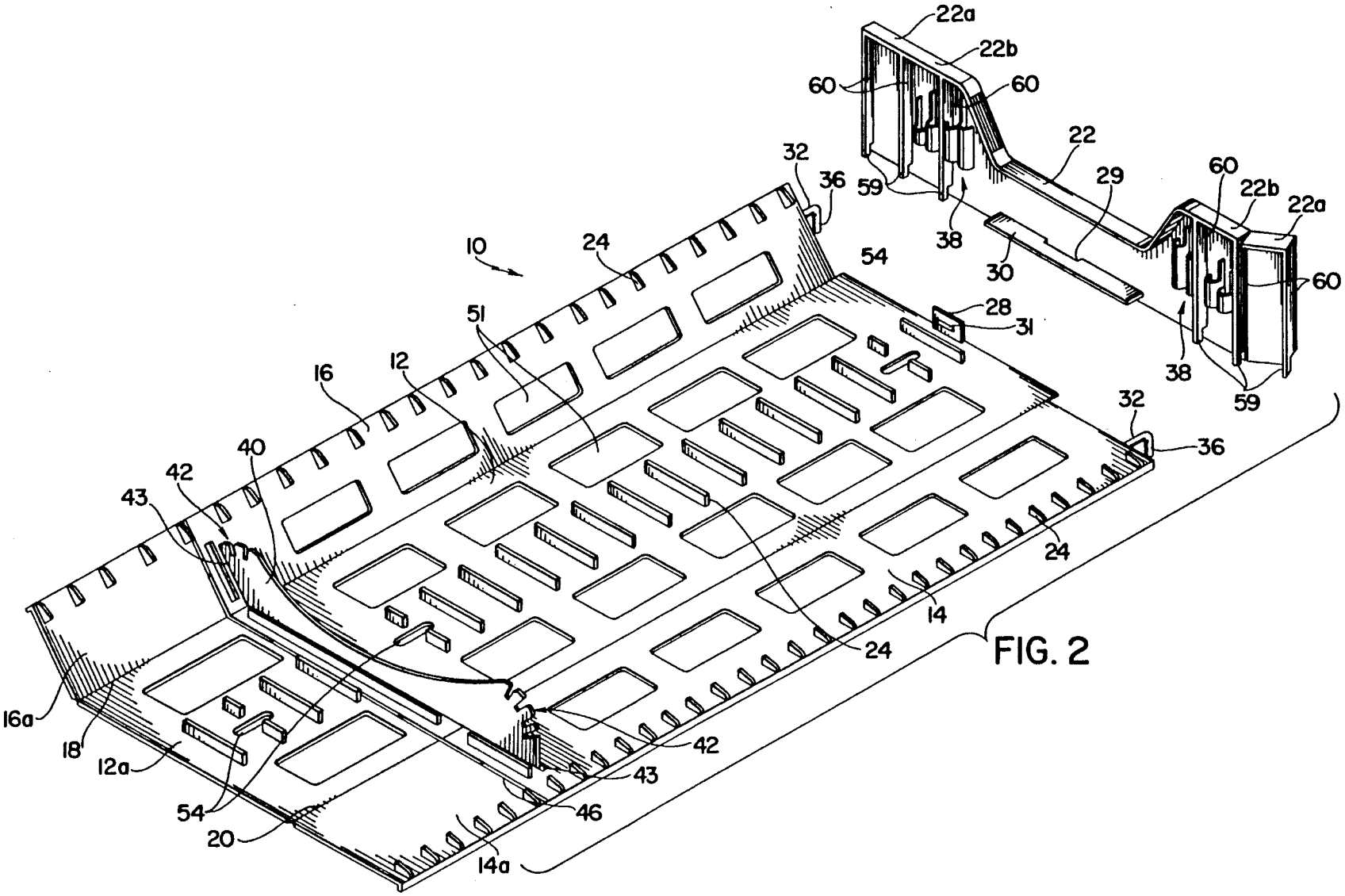
FIG. 2 is a partially exploded perspective view of an empty tray.

Referring now to the drawings, and particularly to FIGS. 1 and 2, the adjustable display tray of the instant invention is illustrated and is generally designated at 10. The display tray 10 is preferably formed from a plastic material, and it comprises a bottom wall 12, and a pair of side walls 14 and 16 connected thereto by living hinges 18 and 20 such that the side walls can be moved to a plurality of different angular positions relative to the bottom wall 12 to receive a plurality of differently sized plates and/or bowls. The display tray 10 further comprises a front wall 22, which is also preferably formed from a plastic material, and a plurality of rib elements 24 which extend along the top inside edges of the side walls 14 and 16 and along the center of the bottom wall 12. The rib elements 24 engage the edges of the plates 26 at three points and act as frictional treads to prevent the plates 26 from tipping over, or from sliding lengthwise of the tray, whether the plates are in a shrink-wrap package 27, as is the more usual situation, or whether they are loosely positioned in the tray. Although the preferred embodiment illustrates a living hinge connection between the bottom wall 12 and the side walls 14 and 16, any type of hinge connection is suitable so long as the side walls can be moved to a plurality of different angular positions.

The front wall 22 is detachably connected to the bottom wall 12 by a tab 28 which extends upwardly from a front edge portion of the bottom wall 12, and slot 29 formed in a flange 30 which extends inwardly from an inner surface of front wall 22 adjacent the bottom edge thereof. When the tab 28 is inserted into the slot 29, a tang 31 on the tab 28 engages the slot 29 and frictionally maintains the tab 28 in assembled position.

Figure 3:
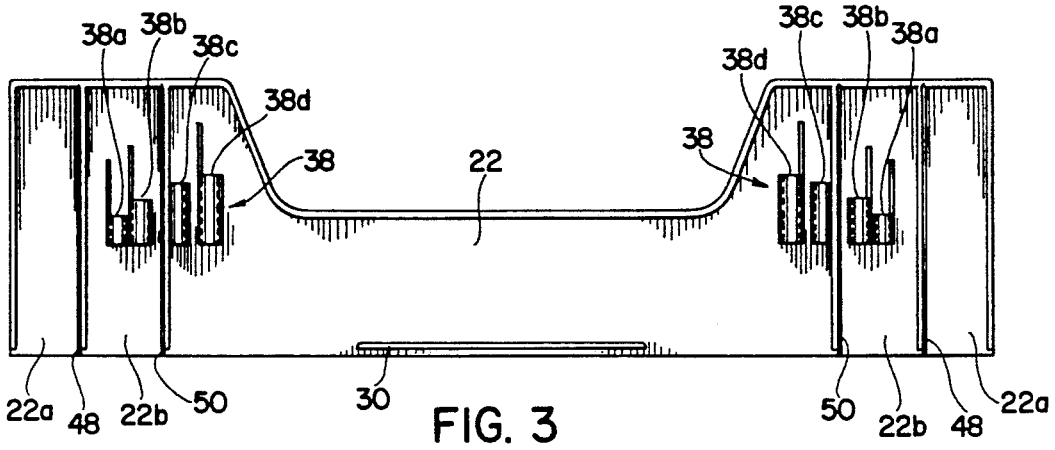
FIG. 3 is an elevational view of the inner surface of the front wall thereof.
Figure 4:
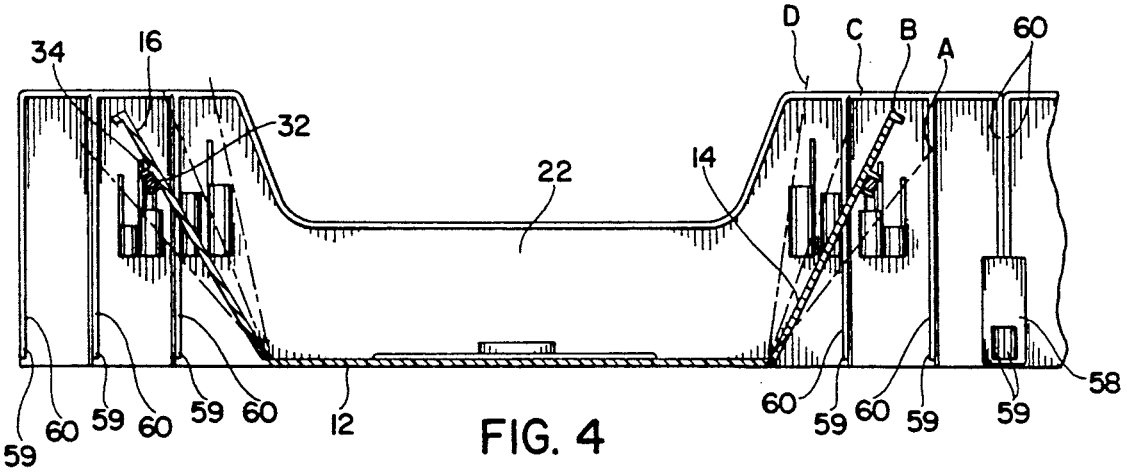
FIG. 4 is a sectional view taken along line 4—4 of FIG. 1.
Figure 5:
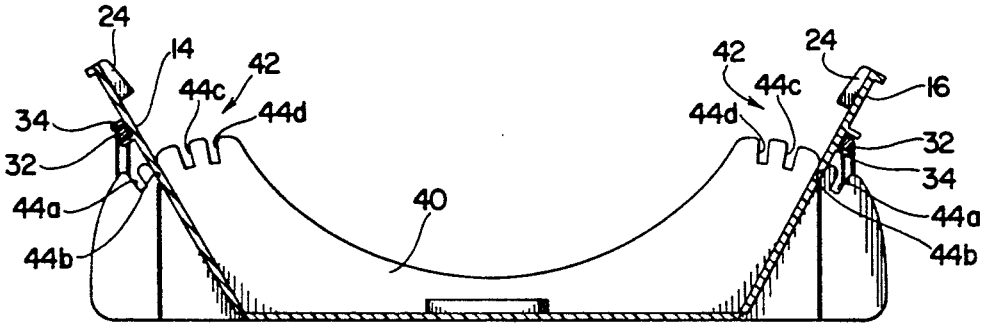
FIG. 5 is a sectional view taken along line 5—5 of FIG. 1.

The side walls 14 and 16 are maintained in a desired angular position by wire rods 32 which extend along and are retained within channels 34 (FIG. 4) on the outside surface of the side walls. Referring now to FIGS. 2 through 4, the wire rods 32 include bent front ends 36 which are adapted to be inserted into a plurality of vertically oriented tubular receptacles integrally formed on the inner surface of wall 22 as generally indicated at 38. The receptacles 38 are symmetrically arranged in pairs on the inner surface of the front wall 22, it being understood that the particular pair of receptacles into which the bent ends 36 of the rods 32 are inserted will determine the angular positions of the side walls. It is pointed out that the illustrated embodiment is provided with four pairs of receptacles 38*a*, 38*b*, 38*c*, and 38*d* (FIG. 3) for positioning the side walls in four different angular positions A, B, C, and D as illustrated in FIG. 4. In this regard, the outermost receptacles 38*a* correspond to position A for receiving ten inch diameter plates, the receptacles 38*b* correspond to position B for receiving 9 inch diameter plates, the receptacles 38*c* correspond to position C for receiving 7 inch diameter plates, and the innermost receptacles 38*d* correspond to position D for receiving smaller diameter bowls. To further maintain the side walls in the desired angular position, a comb-like partition 40 having a plurality of teeth 42 at its upper edges is provided. The partition extends through slots 43 in the side walls 14 and 16 such that the side walls can be snapped in between any two adjacent teeth and fixed in the desired position. In this regard, the teeth 42 define four sets of symmetrically arranged notches 44*a*, 44*b*, 44*c*, and 44*d* which correspond to the angular positions A, B, C, and D, respectively. As can be clearly seen in FIGS. 1 and 2, the front portion of the tray 10 is maintained in the desired angular position by means of the bars 32 and the receptacles 38, whereas the rear portion of the tray 10 is maintained in the desired position by means of the partition 40.

Referring now to FIG. 2, it will be appreciated that the length and width of the display tray are also adjustable. In this regard, the bottom wall 12, side walls 14 and 16, and the front wall 22 are provided with break-away sections. More specifically, the rear portions of the bottom wall 12 and side walls 14 and 16 are provided with break-away sections 12*a*, 14*a*, and 16*a* for shortening the length of the tray 10, as may be sometimes required due to shelf-space limitations. The break-away sections are defined by a reduced thickness score line 46 positioned immediately rearward of the partition 40, and can be removed from the tray 10 by bending the sections at the score line 46 to weaken the thin plastic. Referring to FIGS. 2 and 3, the outer ends of the front wall 22 are also provided with break-away sections 22*a* and 22*b* for reducing the width of the front wall 22 if the tray is to be used for 7" diameter plates or for bowls. The outer break-away sections 22*a* are removed by bending the wall along the reduced thickness score lines 48, whereas the intermediate sections 22*b* are removed by bending the wall along the reduced thickness score lines 50.

As will be apparent in FIGS. 1 and 2, the walls 12, 14, and 16, are preferably provided with a plurality of openings 51, the purpose of which is to minimize the weight of tray 10 and conserve on the plastic material used in the molding of same.

Referring again to FIG. 1, the tray 10 is securable to a table or the like by screws 52 or other like fasteners which may be extended through elongated slots 54 provided in the bottom wall 12. Alternatively, the tray 10 may be attached to a table by double sided tape 56 which is applied to the bottom surface of the bottom wall 12 at appropriate positions.

As an additional feature, the trays 10 are designed so that a plurality of them can be linked together in side by side arrangements. In FIG. 4 a joiner or connecting member 58 is illustrated which is operable for linking two of the display trays 10 together. The joiner 58 hooks behind downwardly projecting fingers 59 of adjacent side flange portions 60 of the front wall 22 and locks the flange portions 60 together. The flange portions 60 and projecting fingers 59 are provided on each break-away section of the front wall 22 so that the trays can be linked together no matter what the width of front walls 22 may be.

Therefore, it can be seen that the instant invention provides a versatile display tray for displaying a plurality of different size plates and bowls. The side walls can be easily adjusted and locked in a plurality of angular positions, and the length and width of the tray can also be adjusted according to display needs. In addition, a plurality of trays may be connected together in side-by-side arrangement. Another significant advantage is that the tray 10 can be shipped in knocked-down disassembled condition to facilitate shipping, and can then be easily assembled at point of use with the desired size adjustments easily made. For all of these reasons it is believed that the display tray of the instant invention represents a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A folding display tray comprising:

a bottom wall;

a pair of side walls hingedly connected thereto such that said side walls may be moved to a plurality of angular positions with respect to said bottom wall to receive a plurality of differently-sized circular articles;

a front wall and means for releasably attaching said front wall to one end of said bottom and side walls; and means for releasably locking said side walls in their desired position of angular adjustment, said releasable locking means comprising a plurality of tubular receptacles provided on the inner surface of said front wall, and rod means extending along said side walls, said rod means including bent front ends which are adapted to be inserted into selected ones of said receptacles for securely maintaining said side walls in said desired position of angular adjustment.

2. A folding display tray comprising:

a bottom wall;

a pair of side walls hingedly connected thereto such that said side walls may be moved to a plurality of angular positions with respect to said bottom wall to receive a plurality of differently-sized circular articles; and means for releasably locking said side walls in their desired position of angular adjustment, said releasable locking means comprising a comb-like partition having a plurality of teeth at an upper edge thereof, said partition extending through slots provided in said side walls so that said side walls can be snapped in-between any pair of adjacent teeth and maintained in said desired position of angular adjustment.

3. The folding display tray of claim 1 further comprising a plurality of rib elements extending along the inside top edges of said side walls and along the center of said bottom wall, said rib elements providing frictional treads which engage the edges of said circular articles and prevent said articles from tipping over.

4. A folding display tray comprising:

a bottom wall;

a pair of side walls hingedly connected thereto such that said side walls may be moved to a plurality of angular positions with respect to said bottom wall to receive a plurality of differently-sized circular articles, said hinge connection comprising living hinges; and means for releasably locking said side walls in their desired position of angular adjustment.

5. A folding display tray comprising:

a bottom wall;

a pair of side walls hingedly connected thereto such that said side walls may be moved to a plurality of angular positions with respect to said bottom wall to receive a plurality of differently-sized circular articles;

said bottom wall and said side walls including break-away sections at one end thereof for shortening the length of said display tray; and means for releasably locking said side walls in their desired position of angular adjustment.

6. A folding display tray comprising:

a bottom wall;

a pair of side walls hingedly connected thereto such that said side walls may be moved to a plurality of angular positions with respect to said bottom wall to receive a plurality of differently-sized circular articles;

a front wall and means for releasably attaching said front wall to one end of said bottom and side walls, said front wall including break-away sections at outer side portions thereof for reducing the width of said front wall; and means for releasably locking said side walls in their desired position of angular adjustment.

7. A folding display tray comprising:

a bottom wall;

a pair of side walls hingedly connected thereto such that said side walls may be moved to a plurality of angular positions with respect to said bottom wall to receive a plurality of differently-sized circular articles;

means for releasably locking said side walls in their desired position of angular adjustment; and means for securing said tray to a flat surface.

8. A folding display tray comprising:

a bottom wall;

a pair of side walls hingedly connected thereto such that said side walls may be moved to a plurality of angular positions with respect to said bottom wall to receive a plurality of differently-sized circular articles;

a front wall and means for releasably attaching said front wall to one end of said bottom and side walls, said attaching means including interengaging tab and slot means; and means for releasably locking said side walls in their desired position of angular adjustment.

9. A folding display tray comprising:

a bottom wall;

a pair of side walls hingedly connected thereto such that said side walls may be moved to a plurality of angular positions with respect to said bottom wall to receive a plurality differently-sized circular articles;

means for releasably locking said side walls in their desired position of angular adjustment; and means for connecting a plurality of said display trays in a side-by-side arrangement.

10. A folding display tray comprising:

a bottom wall;

a pair of side walls hingedly connected thereto such that said side walls may be moved to a plurality of angular positions with respect to said bottom wall to receive a plurality of differently-sized circular articles;

a front wall and means for releasably attaching said front wall to one end of said bottom and side walls;

means for releasably locking said side walls in their desired position of angular adjustment; and means for connecting a plurality of said display trays in a side-by-side arrangement.

11. A folding display tray comprising:

a bottom wall;

a pair of side walls hingedly connected thereto such that said side walls may be moved to a plurality of angular positions with respect to said bottom wall to receive a plurality of differently-sized circular articles;

means for releasably locking said side walls in their desired position of angular adjustment; and said bottom and side walls being constructed of a resilient plastic.

12. In the display tray of claim 8, said bottom wall including an upwardly extending tab at a front edge thereof, said front wall including a slotted flange extending inwardly from said inner surface thereof, said tab being adapted to be inserted into said slotted flange and frictionally maintained therein to secure said front wall to said bottom wall.

13. In the display tray of claim 10, said connecting means comprising a joiner clip which is adapted to engage side flange portions of adjacent front walls.

* * * * *